US010219965B2

(12) United States Patent
Davis

(10) Patent No.: US 10,219,965 B2
(45) Date of Patent: Mar. 5, 2019

(54) SPINE TREATMENT APPARATUS

(71) Applicant: Bass Morris Pty Ltd, Mornington, Vicotoria (AU)

(72) Inventor: Shaun Samuel Davis, Frankston South (AU)

(73) Assignee: Bass Morris Pty Ltd, Mornington, Victoria (AU)

( * ) Notice: Subject to any disclaimer, the term of this patent is extended or adjusted under 35 U.S.C. 154(b) by 715 days.

(21) Appl. No.: 14/721,746

(22) Filed: May 26, 2015

(65) Prior Publication Data

US 2015/0335511 A1 Nov. 26, 2015

(30) Foreign Application Priority Data

May 26, 2014 (AU) ..... 2014901972

(51) Int. Cl.

| | |
|---|---|
| ***A61G 13/00*** | (2006.01) |
| ***A61G 13/12*** | (2006.01) |
| ***A61H 1/02*** | (2006.01) |
| ***A61G 13/08*** | (2006.01) |

(52) U.S. Cl.

CPC ..... *A61G 13/009* (2013.01); *A61G 13/08* (2013.01); *A61G 13/121* (2013.01); *A61G 13/122* (2013.01); *A61G 13/123* (2013.01); *A61G 13/124* (2013.01); *A61G 13/125* (2013.01); *A61G 13/1245* (2013.01); *A61G 13/1295* (2013.01); *A61H 1/0292* (2013.01); *A61G 2200/325* (2013.01); *A61H 2203/045* (2013.01)

(58) Field of Classification Search

CPC ..... A61H 1/0292; A61H 1/0229; A61H 2203/045; A61G 13/122; A61G 13/1295; A61G 13/08; A61G 13/009

USPC ..... 606/237–245

See application file for complete search history.

(56) References Cited

U.S. PATENT DOCUMENTS

| | | | | |
|---|---|---|---|---|
| 3,302,641 A * | 2/1967 | Berne | A61H 1/0222 | 606/245 |
| 5,297,539 A * | 3/1994 | Liebl | A61G 13/009 | 5/618 |
| 6,695,796 B1 * | 2/2004 | Solmor | A61G 13/121 | 128/845 |
| 7,357,777 B1 * | 4/2008 | Meyers | A61H 1/0292 | 128/845 |
| 2005/0181917 A1 * | 8/2005 | Dayal | A61H 1/0222 | 482/142 |
| 2011/0107516 A1 * | 5/2011 | Jackson | A61G 13/04 | 5/608 |
| 2012/0179203 A1 * | 7/2012 | Kellner | A61F 5/04 | 606/245 |

(Continued)

*Primary Examiner* — Colin W Stuart
*Assistant Examiner* — Douglas Sul
(74) *Attorney, Agent, or Firm* — TraskBritt, P.C.

(57) ABSTRACT

A patient support apparatus for spinal conditions comprising a knee support 10,12, a patient torso support 32,60 for supporting a patient in the kneeling position, means 32 for supporting a patient's torso in a range of inclinations below horizontal in order to cause a mass of the patient's torso to tension the spine. The torso support 32,60 is supported by a radius arm 50 that is pivoted below the torso support 32,60, is free to swivel about a fixed joint 52 located forward of, and below the level of, the knee support 10,12, and is inclined upwardly forwardly towards a ring pad support 60 for a patient's head.

15 Claims, 3 Drawing Sheets

(56) References Cited

U.S. PATENT DOCUMENTS

2016/0081872 A1* 3/2016 Samson ..... A61H 1/0292
602/36

* cited by examiner

SPINE TREATMENT APPARATUS

CROSS-REFERENCE TO RELATED APPLICATION

This application claims the benefit of Australian Patent Application No. 2014901972, filed May 26, 2014, the disclosure of which is hereby incorporated herein in its entirety by this reference.

TECHNICAL FIELD

Osteopaths, physiotherapists and chiropractors treat patients by moving, stretching and massaging a patient's muscles and joints. The relief of neck pain, shoulder pain and limb pain is part of their work but this disclosure concerns the relief of back pain.

BACKGROUND

Portable devices for tensioning the spine of kneeling patients must be of a suitable size because they are worn by the patient during the treatment.

If the manipulation and massage of the spine and neck is frequently required in consulting rooms, it helps to have a static treatment apparatus which will take patients of different size.

BRIEF SUMMARY

The apparatus aspect of the disclosure provides a patient support apparatus for spinal conditions comprising means for supporting a patient in the kneeling position, means for supporting the torso in a range of inclinations below horizontal in order to cause the patients torso mass to tension the spine. The knee support may be a pad supported off the floor to bring the patient's back within comfortable reach of the practitioner. The apparatus may also have an upright reaction surface, for example, a foot plate, against which the feet may push. The distance between the knee support and the foot plate may be adjustable for different calf lengths.

The apparatus may have means for arresting forward motion of the torso when the patient occupies the apparatus by presenting an upright barrier to the thighs. The thigh arrester may be a pad wide enough to accommodate patients with wide hips, for example, individuals with hip measurements of 1200 mm or greater. This pad may be adjustable in height for thigh length.

The torso may likewise be a pad mounted forwardly of the leg arrester and capable of inclination and locking at selected angles in order to change the tension imposed on the spine.

The torso pad support may be a radius arm pivoted below the pad. The arm may be telescopic in order to be adjustable for spine length.

A useful treatment option is being able to allow the spine to swing laterally left and right when supported by the torso pad. Accordingly the torso support may permit both inclination and lateral swing at 90 degrees to the inclination axis.

The torso support may have a ball joint swivel or other mechanical equivalent.

The range of swing may be controlled by a tie connected between the arm and the apparatus frame.

The torso pad support may include a head support lying in advance of the torso pad. The head support may be a ring-shaped pad.

In order to take the weight of the patient's arms, the radius arm may have a central extension with handgrips projecting therefrom. Preferably the extension is a T-bar.

ADVANTAGEOUS EFFECTS OF DISCLOSURE

1. The apparatus presents the spine of the patient to the practitioner at a working height and is adjustable for patients of different size.

2. The apparatus imposes traction during support by inclining the torso downwards while at the same time imposes traction as the patient's torso swings left and right while inclined.

BRIEF DESCRIPTION OF DRAWINGS

One embodiment of the disclosure is now described with reference to the accompanying drawings, in which.

DETAILED DESCRIPTION

Figure 1:
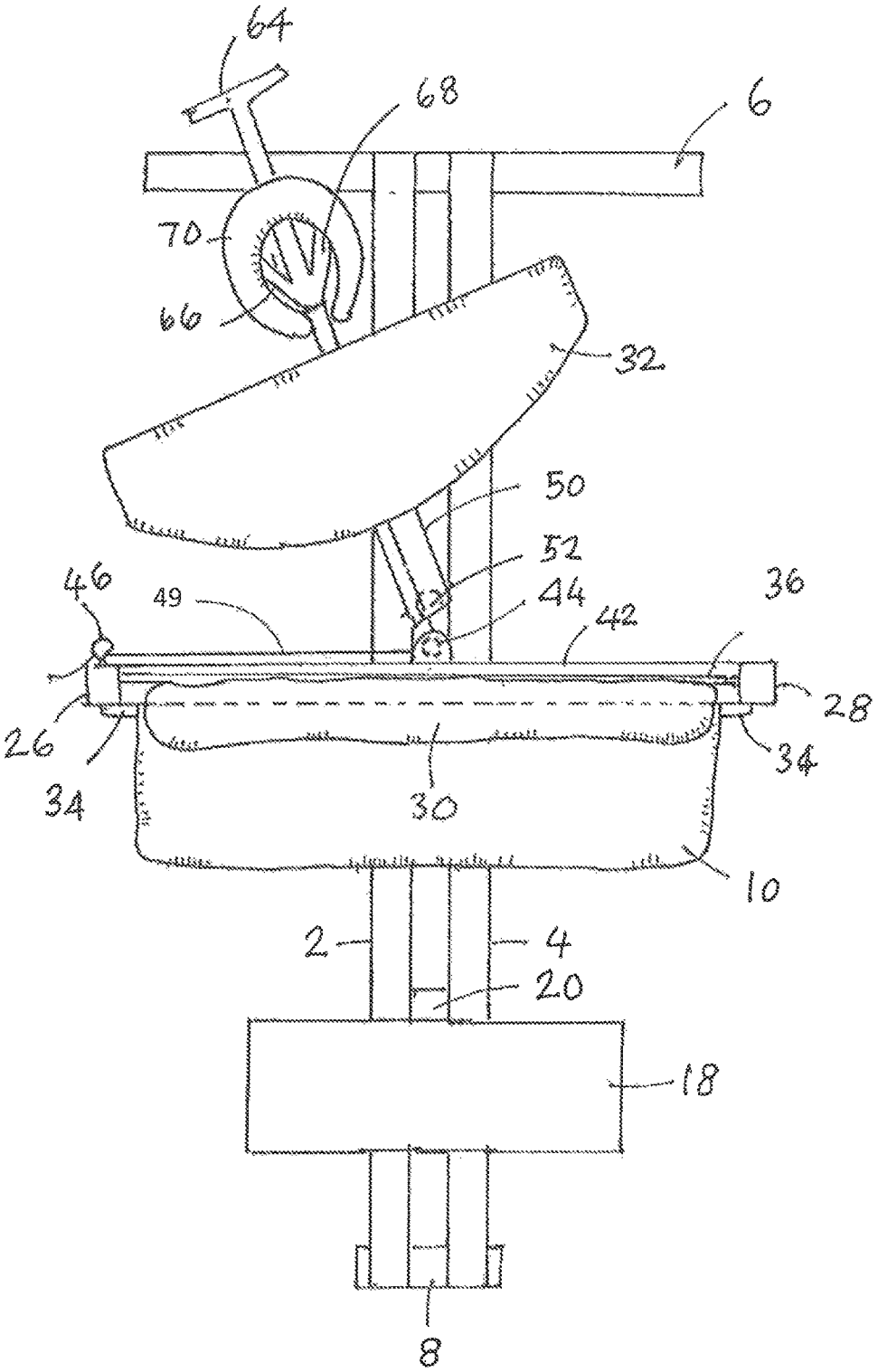
FIG. 1 is a plan of the apparatus.
Figure 2:
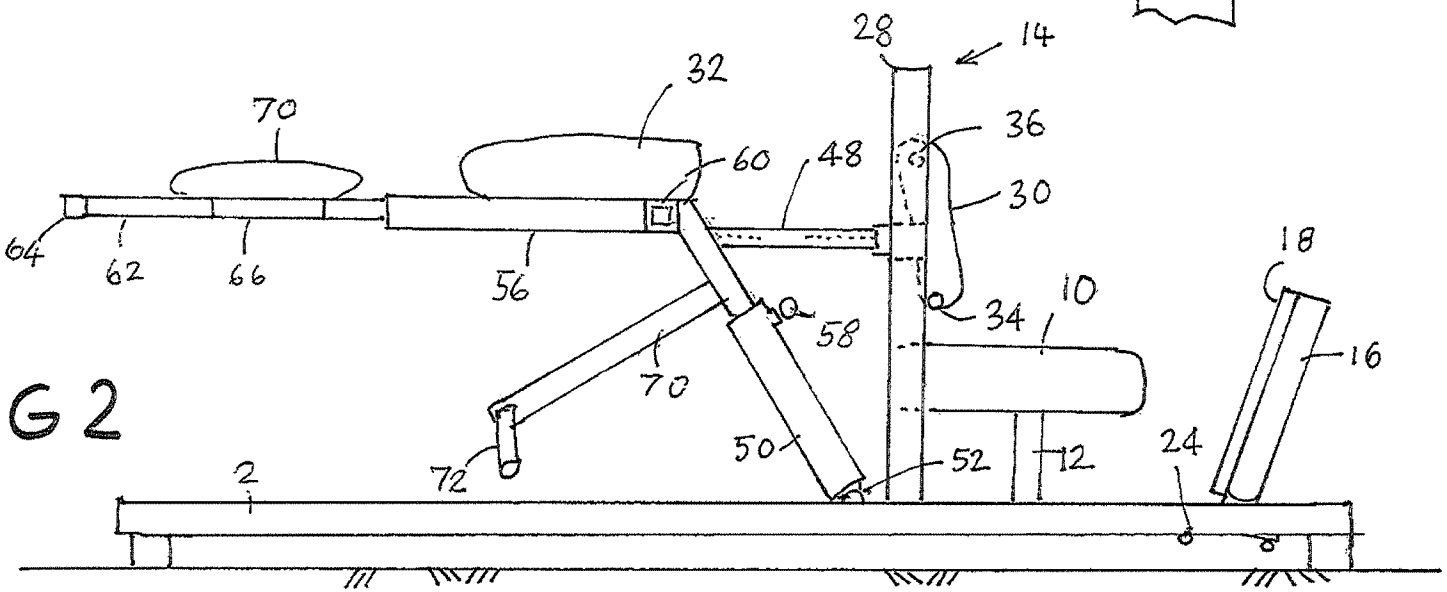
FIG. 2 is a side elevation.

Referring now to FIGS. 1 and 2, the base of the apparatus consists of a pair of steel tubular beams 2, 4 raised on a crossbar 6 and a spacer 8.

Kneepad 10 rests on a knee frame 12, which lies behind U-shaped centre frame 14. To the rear of the kneepad is a foot tube 16 to which is welded a rectangular foot plate 18. Foot tube 16 is fixed to a rocker tube 20, which slides between beams 2, 4 to a suitable distance and as soon as the patient's feet tilt the foot plate the rocker tube rotates causing a pin 24 to press against the underside of beams 2, 4 locking the plate 18 in position.

Kneepad 10 rests on the horizontal member of the centre frame and the posts 26, 28 of the centre frame support thigh pad 30.

The purpose of this pad is to arrest the legs on the kneepad so that when the patient bends over the thigh pad the feet press against the foot plate 18 and the patient's torso rests on chest pad 32.

Figure 3:
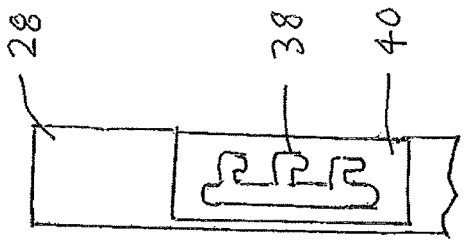
FIG. 3 is a side view of a height adjuster for the thigh pad.
Figure 4:
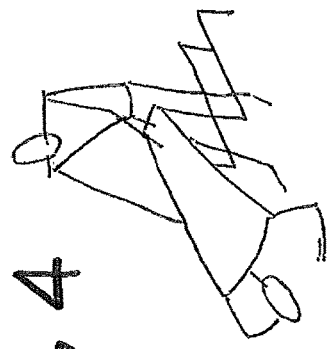
FIG. 4 is a diagram of the patient and practitioner during treatment.

Thigh pad 30 has a sheet metal frame which supports two parallel horizontal steel rods 34, 36. Lower rod 34 slides up and down the posts 26, 28 and the upper rod 36 engages one of three slots 38 in adjuster plates 40 fixed to the posts according to small, medium, large leg length of the patient (see FIG. 3).

The centre frame posts 26, 28 are joined by tie 42, the purpose of which is to support pulley wheel 44. Post 26 has a tape lock 46 for a tape 49, which extends from the tape lock 46 around pulley wheel 44 to radius arm 50. The radius arm is free to swivel, being fixed to ball joint 52 which is supported between beams 2, 4.

Radius arm 50 is hollow and lined with friction pads so that angle tube 56 can slide and be locked by retainer 58 allowing the angle tube to dip below horizontal in order to tension the patient's spine.

Crossbar 60 supports the chest pad 32 and the angle tube receives telescopic tube 62, which is slid forwards or backwards using handle 64. Tube 62 has two branches 66, 68, which together support ring pad 70 for the patient's head. Angle tube 56 has a downwardly inclined handrest tube 70 with splayed handgrips 72, 74.

In operation, the patient kneels on kneepad 10 and the practitioner moves footplate 18 into contact with the patients feet. The patient is steadied by handgrips 72, 74.

The height of thigh pad 30 is adjusted, if necessary, and the patient bends forward to lie on the chest pad 32. Handle 64 brings the ring pad to underlie the patients face.

Once these adjustments have been made, the patient unbends and the practitioner loosens the tape lock 46 allowing the tape to lengthen, reducing the angle of the radius arm 50. When the patient bends forward this angular change causes the spine to go into traction. The parts of the patient which need massage or manipulation are accessible and at a suitable working height for the practitioner.

Figure 5:
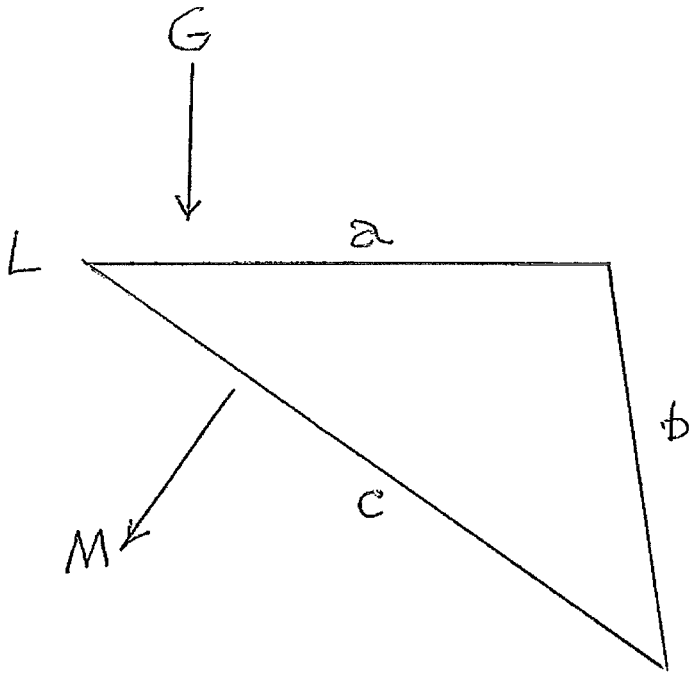
FIG. 5 is a diagram of the triangle of forces.

The efficiency of the apparatus depends on the force triangle shown in FIG. 5. Side 'a' represents the patient's torso. Side 'b' represents the patient's thighs. Side 'c' represents the radius arm. Points 'ab' and 'bc' (representing the hips and universal joint, respectively) are fixed in space while point 'ac' (the armpits) is freely moveable. All angles are variable and unrestricted.

The weight of the patient torso places a vertical force downward on the radius arm 'c' which, due to its fixed pivot base, creates a forward arc. This forward arc creates a lengthening of side 'a' (the torso) resulting in traction of the spine. The degree of traction is tempered by an adjustable webbing strap 48 between the radius arm 50 and the thigh pad support 30.

Arrow G indicates the direction of gravity tending to elongate the spine. The leading apex L of the triangle shows the position of the patient's armpits. Arrow M is 90 degree to the radius arm 50 and indicates the direction of movement controlled by adjustable strap 48.

The illustrations, photographs and drawings, if any, form part of the disclosure of this specification as does the description, illustrations, photographs and drawings of any associated provisional or parent specification or of any priority document, if any, all of which are imported hereinto as part of the record hereof.

Finally it is to be understood that various alterations, modifications and/or additions may be incorporated into the various constructions and arrangements or parts without departing from the spirit and ambit of the disclosure.

What is claimed is:

1. A patient support apparatus for spinal conditions, the patient support apparatus comprising:

a knee support supported off a floor and adapted to support a patient in a kneeling position, a torso support adapted to support a patient's torso in a range of inclinations below horizontal; and a frame, wherein the torso support is supported by a radius arm that is:

pivoted below the torso support;

free to swivel about a fixed joint located forward of, and below the level of, the knee support;

connected to the frame by a strap; and inclined upwardly and forwardly, whereby the torso support is adapted to tension the spine of a patient as the patient torso's own weight causes the torso support to rotate about the fixed joint away from the knee support.

2. The patient support apparatus of claim 1, wherein the patient support apparatus has an upright reaction surface adapted as a rest for the patient's feet and the distance between the knee support and the reaction surface is adjustable for different calf lengths.

3. The patient support apparatus of claim 1, further comprising a thigh arrester located above the knee support that is adapted to arrest forward motion of the torso by presenting an upright barrier to the thighs.

4. The patient support apparatus of claim 3, wherein the thigh arrester comprises a pad adapted to accommodate patients with wide hips.

5. The patient support apparatus of claim 3, wherein the torso support is mounted forwardly of the thigh arrester and is capable of inclination and locking at selected angles in order to change the tension imposed on the spine.

6. The patient support apparatus of claim 5, wherein the patient support apparatus is adapted to allow the patient's spine to swing laterally left and right when supported by the torso support, the torso support permitting both inclination and lateral swing at 90 degrees to an inclination axis.

7. The patient support apparatus of claim 1, wherein the radius arm is telescopic in order to be adjustable for spine length.

8. The patient support apparatus of claim 1, wherein the fixed joint is a ball joint swivel.

9. The patient support apparatus of claim 1, wherein the torso support includes a head support and a torso pad, the head support lying in advance of the torso pad.

10. The patient support apparatus of claim 9, wherein the head support is a ring-shaped pad.

11. The patient support apparatus of claim 10, wherein the head support has a central extension with handgrips projecting therefrom in order to take the weight of the patient's arms.

12. The patient support apparatus of claim 11, wherein the extension is a T-bar.

13. The patient support apparatus of claim 1, wherein the patient support apparatus imposes traction during use and is adapted to incline the patient's torso downwards while at the same time imposing traction as the patient's torso swings left and right while inclined.

14. The patient support apparatus of claim 1, wherein a length of the strap is adjustable.

15. The patient support apparatus of claim 1, wherein a range of swing of the radius arm is controlled by the strap.

* * * * *